United States Patent [19]

Sölver

[11] 4,342,891

[45] Aug. 3, 1982

[54] CIRCUIT BREAKER WITH MEANS FOR PRODUCING A FLOW OF ARC-EXTINGUISHING GAS

[75] Inventor: Carl E. Sölver, Ludvika, Sweden

[73] Assignee: ASEA Aktiebolag, Västerås, Sweden

[21] Appl. No.: 166,859

[22] Filed: Jul. 8, 1980

[30] Foreign Application Priority Data

Jul. 11, 1979 [SE] Sweden ..... 7906035

[51] Int. Cl.[3] ..... H01H 33/88

[52] U.S. Cl. ..... 200/148 A; 200/150 G

[58] Field of Search ..... 200/148 A, 150 G

[56] References Cited

U.S. PATENT DOCUMENTS 463,172 6/1943 Fernier ..... 200/148 A 2,147,497 2/1939 Prince et al. ..... 200/150 G

*Primary Examiner*—Robert S. Macon

*Attorney, Agent, or Firm*—Watson, Cole, Grindle & Watson

[57] ABSTRACT

A puffer type circuit breaker is provided with a pump means consisting of a piston and a cylinder for producing a blast of arc-extinguishing gas. The piston is joined to one contact of the circuit breaker and the cylinder to the other contact. Both contacts are connected to an operating device which is adapted, during the first part of a breaking operation, to move the contacts in opposite directions away from each other, whereupon one contact and the piston joined thereto are returned to the initial position.

3 Claims, 4 Drawing Figures

CIRCUIT BREAKER WITH MEANS FOR PRODUCING A FLOW OF ARC-EXTINGUISHING GAS

BACKGROUND

1. Field of the Invention

The present invention relates to puffer type circuit breakers, and in particular to such circuit breakers having a gaseous arc-extinguishing medium and which generate a blast of arc-extinguishing gas towards the contact area of the circuit breaker.

2. Prior Art

In circuit breakers of the so-called puffer-type, the gas blast energy is generated by compression of gas in a cylinder during the breaking operation. In order for such a breaker to manage a given interruption involving a certain current at a certain recovery voltage, two conditions have to be fulfilled at the zero current passage in question:

(a) The contact distance shall exceed a certain minimum value;

(b) The blast pressure in the cylinder shall exceed a certain minimum value.

Since the phase position of the current may vary arbitrarily, the extinguishing interval of the breaker must be sufficiently long, that is, the breaker shall fulfil conditions (a) and (b) for a sufficiently long time, 12–18 milliseconds (condition c).

In a conventional puffer type circuit breaker, the movable contact normally has to perform about two-thirds of its stroke before conditions (a) and (b) are fulfilled. When endeavouring to make such a breaker more rapid, one will soom come into conflict with condition c, that is, the demand for a sufficiently long extinguishing interval, since the pump means consisting of the piston and the cylinder reaches its end position too soon and the blast pressure disappears. For this reason, conventional puffer type circuit breakers will probably not reach shorter breaking times than 2 cycles (i.e. 33 milliseconds in a 60 Hz system).

In a proposed puffer-type circuit breaker as described in German Auslegeschrift No. 1,966,973, a movable bridging contact, which is joined to the puffer cylinder, connects two nozzle contacts, one of which is fixed and the other is movable and joined to the puffer piston. During the first part of the breaking operation, the movable nozzle contact is moved towards the fixed nozzle contact, and the speed at which the contact distance initially increases is determined solely by the movement of the bridging contact.

SUMMARY OF THE INVENTION

The purpose of the present invention is to provide a puffer-type circuit breaker for a higher opening speed than in prior art circuit breakers of this kind without conflicting with the above-mentioned condition c. This is achieved by an operating device which during the first part of a breaking operation moves the contacts in opposite directions away from each other, whereupon the first of said contacts and the piston connected thereto are moved back substantially to the initial position.

In a breaker design according to the invention, the above-mentioned conditions a and b are fulfilled after only about one-third of the length of stroke for the movable contact joined to the puffer cylinder, since the piston of the pump means and the counter-contact joined to the piston are adapted to move first opposite to the direction of movement of the puffer cylinder and thereby to contribute to create a pressure and a contact distance, respectively. Once the conditions a and b are fulfilled, the piston and the counter-contact stop and then gradually move back to their initial position. This backward movement is adapted such that the remaining compression volume is gradually reduced towards the value zero at the end of the stroke. In this way, the conditions a and b may be fulfilled during all the remaining part of the stroke, that is, for about two-thirds of the whole stroke. A considerably shorter breaking time than two cycles may therefore be obtained. A breaking time of one cycle cannot be excluded.

BRIEF DESCRIPTION OF THE DRAWINGS

The invention will be described in greater detail with reference to an embodiment shown schematically in the accompanying drawing, in which.

DETAILED DESCRIPTION

Figure 1:
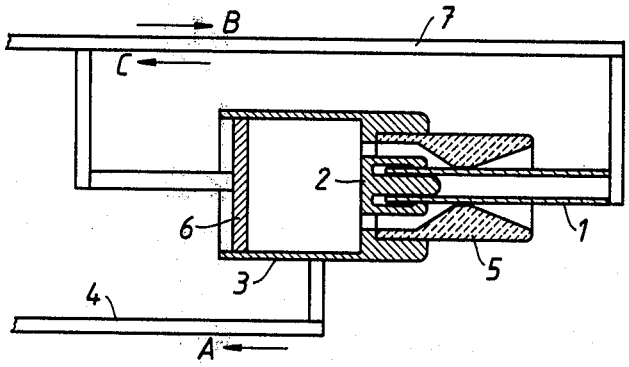
FIG. 1 shows a puffer-type circuit breaker according to the invention in the closed position.
Figure 2:
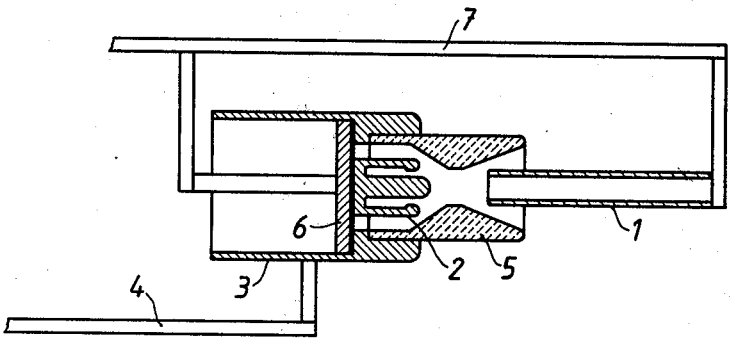
FIG. 2 shows the circuit breaker in the open position.

The circuit breaker shown in FIGS. 1 and 2 is accomodated in an elongated extinguishing chamber (not shown) which is preferably totally closed and filled with electro-negative gas, for example sulphur hexafluoride, of an overpressure of a few atmospheres. The breaker has a contact unit with two cooperating contacts, one of which is a plug contact 1 and the other a sleeve contact 2. The contacts 1 and 2 are axially movable with respect to each other between a closed position (FIG. 1) and an open position (FIG. 2). The sleeve contact 2 is fixedly joined to a puffer cylinder 3 and connected to an operating device (not shown) via an operation rod 4. A blast nozzle 5 of a suitable insulating material, for example polytetrafluoro ethylene, is also mounted on the sleeve contact 2 in such a way that the nozzle during a breaking operation will surround the area between the contacts 1 and 2 (the contact area). The puffer cylinder 3 contains a sliding piston 6 sealing against the cylinder wall, the piston being fixedly joined to the plug contact 1 and connected, via an operating rod 7, to the operating device of the breaker. The external current connections to the breaker take place with the aid of sliding contacts (not shown) to the plug contact 1 and to the puffer cylinder 3, respectively, which is made of copper or aluminium.

Upon an opening operation, the sleeve contact 2, the nozzle 5 and the puffer cylinder 3 move to the left in the figure (arrow direction A) driven by the operating rod 4. At the same time, the plug contact 1 and the piston 6 move first to the right in the figure (arrow direction B) and then back again (arrow direction C) substantially to the initial position, driven by the operating rod 7. The length of stroke for the latter movement (operating rod 7) is approximately one-third of the stroke for the former movement (operating rod 4).

Figure 3:
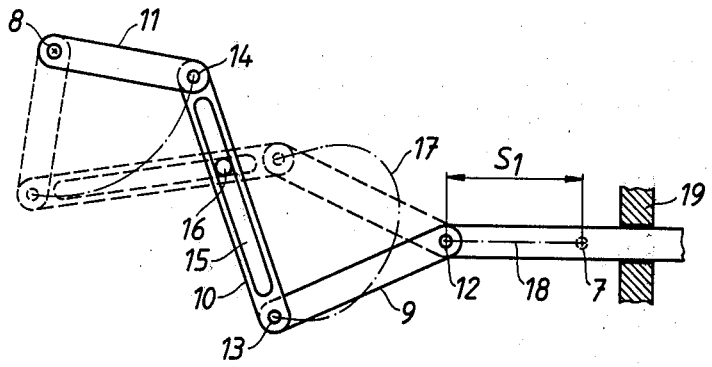
FIG. 3 shows a rod system for operation of the first contact of the breaker.
Figure 4:
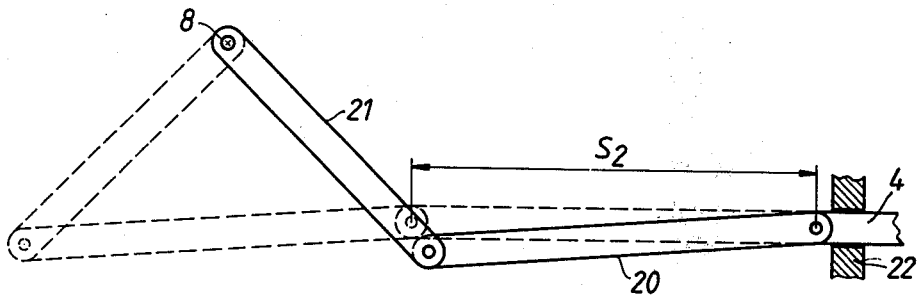
FIG. 4 shows a rod system for operation of the second contact of the breaker.

FIGS. 3 and 4 show examples of how the contacts of the circuit breaker may be connected via separate linkage systems to a common operating shaft 8, on which the drive force of the operating device is applied. The linkage systems are drawn with unbroken lines in the positions in which they are when the breaker is in the closed position, as well as with broken lines in the positions in which they are when the breaker is in the open position. Both the FIGS. 3 and 4 are drawn on the same scale.

FIG. 3 shows how the reciprocating movement of the operating rod 7 of the plug contact 1 may be accomplished. One end of the operating rod 7 is connected, via two links 9 and 10, to an arm 11 which is non-rotatably joined to the drive shaft 8 of the operating device. The operating rod 7 and the link 9 are joined at a joint 12, the link 9 and the link 10 at a joint 13, and the link 10 and the arm 11 at a joint 14. The link 10 has an elongated guide slot 15 running in the longitudinal direction of the link, a stationarily arranged guiding pin 16 engaging guide slot 15.

Opening of the breaker is brought about by turning the drive shaft 8 of the operating device clockwise through an angle of about 90°. The joint 13 between the links 9 and 10 thus follows a curve 17, whereas the joint 12 between the link 9 and the operating rod 7 follows a straight line 18. A reciprocating rectilinear movement is then conveyed to the operating rod 7, which is guided in a slide bearing 19. The dimension line $s_1$ denotes the length of stroke of the rod 7.

As is clear from FIG. 4, the operating rod 4 for the sleeve contact 2 and the cylinder 3 is connected via a link 20 to an arm 21 which is non-rotatably joined to the drive shaft 8 of the operating device. When, upon an opening of the breaker, this drive shaft 8 is rotated through the above-mentioned angle, a rectilinear movement to the left in the figure is conveyed to the operating rod 4, which is guided in a slide bearing 22. The length of stroke $s_2$ for the operating rod 4 is approximately three times the length of stroke $s_1$ for the operating rod 7.

The invention is not limited to the embodiment shown, but several modifications are feasible within the scope of the inventive concept. For example, the contacts 1 and 2 need not necessarily be operated via linkage systems from a common drive shaft; alternatively the contacts may have individual operating devices.

What is claimed is:

1. Electric circuit breaker having a gaseous arc-extinguishing medium comprising:

a first and a second contact, said contacts being movable in relation to each other between an engaged and a disengaged position;

a pump means including a piston and a cylinder, said piston being joined to said first contact, and said cylinder being joined to said second contact, said pump means, during a breaking operation, compressing the gas in said cylinder to create a blast of arc-extinguishing gas towards the contact area of the circuit breaker;

an operating device being connected to said contacts, said operating device including means for moving the contacts in opposite directions away from each other during the first part of a breaking operation, and thereafter moving said first contact and the piston connected thereto back substantially to the initial position, while continuing the movement of said second contact and the cylinder connected thereto in the initial direction to said disengaged position.

2. Circuit breaker according to claim 1, wherein the length of stroke ($s_1$) for the contact joined to the piston is approximately one-third of the length of stroke ($s_2$) for the contact joined to the cylinder.

3. Circuit breaker according to either claim 1 or 2, wherein the contacts are connected to the operating device via individual rod systems.

* * * * *